US006779506B1

(12) United States Patent
Beaucaire et al.

(10) Patent No.: US 6,779,506 B1
(45) Date of Patent: Aug. 24, 2004

(54) ENGINE BRAKE CONTROL PRESSURE STRATEGY

(75) Inventors: James T. Beaucaire, Glen Ellyn, IL (US); David S. Hlavac, Elmhurst, IL (US); David V. Rodgers, Bloomingdale, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 0 days.

(21) Appl. No.: 10/668,854

(22) Filed: Sep. 23, 2003

(51) Int. Cl.[7] ..... F02D 13/04
(52) U.S. Cl. ..... 123/321; 123/446
(58) Field of Search ..... 123/90.12, 90.15, 123/568.14, 321–325, 446, 481, 493; 701/103, 110, 112

(56) References Cited

U.S. PATENT DOCUMENTS 5,564,386 A * 10/1996 Korte et al. ..... 123/321
5,735,242 A * 4/1998 Kahlenbeck et al. ..... 123/322
6,681,740 B1 * 1/2004 Majewski et al. ..... 123/320
6,705,282 B2 * 3/2004 Hlavac ..... 123/322

* cited by examiner

*Primary Examiner*—Hai Huynh
(74) *Attorney, Agent, or Firm*—Dennis Kelly Sullivan; Susan L. Lukasik; Jeffrey P. Calfa

(57) ABSTRACT

An engine (10) has a hydraulic system (28) that serves both fuel injectors (22) and hydraulic actuators (40) of an engine brake that brakes the engine by controlling exhaust gas flow during engine braking. Pressure of the hydraulic fluid is set by an injection control strategy when a brake control pressure strategy is inactive. When the brake control pressure strategy is active, braking of the engine occurs when hydraulic fluid is delivered to the actuators. The brake control pressure strategy signals pressure of the hydraulic fluid supplied to the one or more actuators that is in excess of a pressure determined by a brake control pressure strategy. The brake control pressure strategy then limits pressure of the hydraulic fluid.

19 Claims, 3 Drawing Sheets

FIG. 1
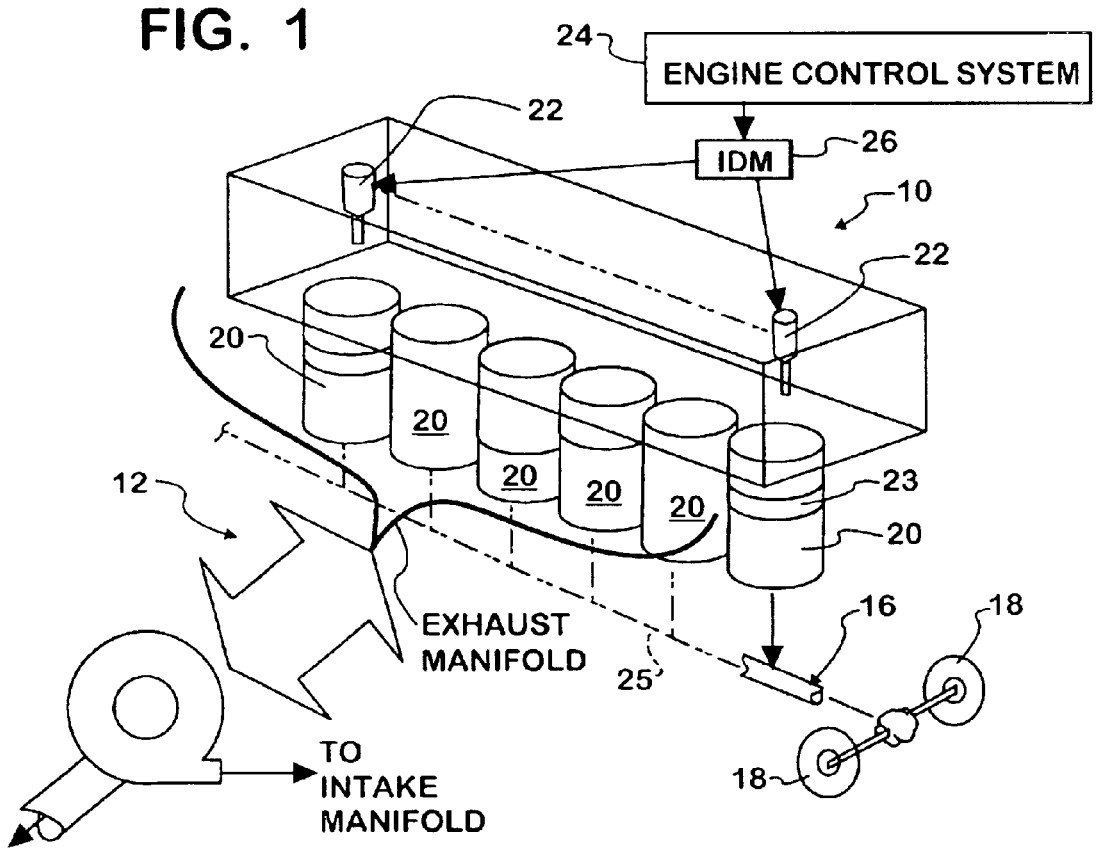
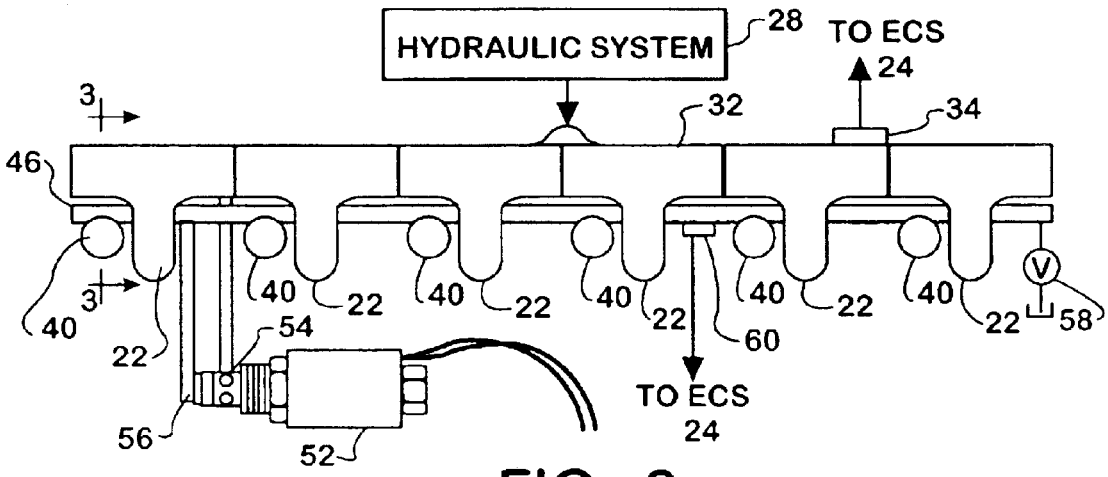
FIG. 2

ENGINE BRAKE CONTROL PRESSURE STRATEGY

FIELD OF THE INVENTION

This invention relates to internal combustion engines for propelling motor vehicles, and more particularly to a strategy for controlling an engine brake that has a hydraulic actuator that is actuated during braking.

BACKGROUND OF THE INVENTION

When it is desired to slow a motor vehicle being propelled by an internal combustion engine, the driver typically releases the accelerator pedal. That action alone will cause the vehicle to slow due to various forces acting on the vehicle. Driver action may also include applying the vehicle service brakes, depending on the amount of braking needed.

A known method for retarding the speed of a running internal combustion engine in a motor vehicle without necessarily applying the service brakes comprises increasing engine back-pressure, and in a motor vehicle, a temporary increase in engine back-pressure can be effective to aid in decelerating the vehicle provided that the vehicle drivetrain is keeping the driven wheels coupled to the engine. With the accelerator pedal released, engine fueling diminishes, or even ceases. Instead of flowing toward the driven wheels, the power flow through the drivetrain reverses direction, with the kinetic energy of the moving vehicle now being dissipated by operating the engine as a pump.

Any of various known engine brakes and methods may be used to temporarily increase engine back-pressure in order to retard the speed of a moving motor vehicle. Regardless of the particular type of engine brake, an actuator is typically present in the braking mechanism A hydraulic actuator is one example.

Certain diesel engines have fuel injection systems that utilize hydraulic fluid, or oil, under pressure to force fuel into engine combustion chambers. The hydraulic fluid is supplied from a hydraulic rail, or oil rail, to a respective fuel injector at each engine cylinder. When a valve mechanism of a fuel injector is operated by an electric signal from an engine control system to inject fuel into the respective cylinder, the hydraulic fluid is allowed to act on a piston in the fuel injector to force a charge of fuel into the respective combustion chamber. The hydraulic fluid is delivered to the rail by a pump, and as an element of the fuel injection control strategy executed by the engine control system, the hydraulic pressure in the oil rail is regulated to provide an appropriate injection control pressure (ICP).

SUMMARY OF THE INVENTION

A hydraulic actuator in an engine brake system can take advantage of the already available source of hydraulic fluid, or oil, in the oil rail. But because ICP in the oil rail is controlled by the fuel injection control strategy that is embedded in the engine control system (ECS), the inclusion of a brake control pressure (BCP) strategy in an ECS needs to address implications of using ICP for engine brake actuation. Likewise, use of ICP for actuating the engine brake may have implications on the fuel injection control strategy.

Excessively high ICP may be undesirable in an engine brake system A malfunction in a BCP valve that controls the delivery of hydraulic fluid to a hydraulic actuator of an engine brake system may cause the BCP valve to stay open when it should close so that ICP will not be removed from the actuator when it should. That could be a source of potential damage to the engine.

Hence, the ability of a BCP strategy to utilize ICP requires a proper interaction between the BCP strategy and the ICP strategy.

An important aspect of the present invention involves an engine control system strategy that provides a novel BCP strategy for a hydraulic-actuated engine brake and that properly interrelates a BCP strategy and an ICP strategy so that brake application can take advantage of hydraulic fluid, or oil, that is used for operating engine fuel injectors while guarding against the possibility that the use of ICP might damage the engine in the unexpected event that unintended pressures are applied to the actuator.

Accordingly, one generic aspect of the present invention relates to an internal combustion engine comprising a fueling system for forcing fuel into engine combustion chambers where the fuel is combusted to power the engine and an exhaust system through which exhaust gases generated by combustion of fuel in the combustion chambers pass from the engine. An engine brake system is associated with the exhaust system to brake the engine by controlling exhaust flow during engine braking and comprises one or more hydraulic actuators that is or are actuated during braking of the engine by the engine brake system.

A hydraulic system supplies hydraulic fluid under pressure both to the fueling system for forcing fuel into the combustion chambers and to the one or more actuators. A control system controls various aspects of engine operation, including controlling braking of the engine by selectively communicating hydraulic fluid to the one or more actuators.

A fuel injection control strategy in the control system provides closed-loop control of injection control pressure to cause injection control pressure to correspond to a desired injection control pressure set by the fuel injection control strategy.

A brake control pressure strategy in the control system signals hydraulic pressure supplied to the one or more actuators in excess of a pressure determined by the brake control pressure strategy and imposes limitation on injection control pressure when such excess pressure is signaled.

Another aspect of the invention relates to the control system just described.

Still another aspect relates to a method of control of pressure of hydraulic fluid that serves both engine fuel injectors and one or more actuators of an engine brake.

The foregoing, along with further features and advantages of the invention, will be seen in the following disclosure of a presently preferred embodiment of the invention depicting the best mode contemplated at this time for carrying out the invention. This specification includes drawings, now briefly described as follows.

BRIEF DESCRIPTION OF THE DRAWINGS

FIG. 1 is a pictorial diagram of an exemplary internal combustion engine in a motor vehicle, including portions of an engine brake system.

FIG. 2 is a pictorial diagram showing more detail.

DESCRIPTION OF THE PREFERRED EMBODIMENT

Figure 3:
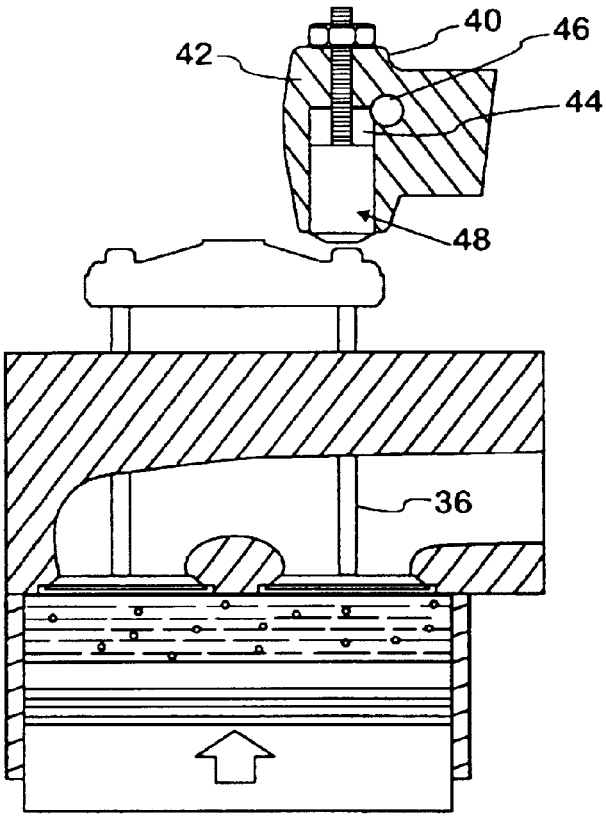
FIG. 3 is a cross section view in the general direction of arrows 3—3 in FIG. 2 showing one operating condition.

FIG. 1 shows portions of an exemplary internal combustion engine 10 useful in explaining principles of the present invention. Engine 10 has an intake system (not specifically shown in FIG. 1) through which air for combustion enters the engine and an exhaust system 12 through which exhaust gases resulting from combustion exit the engine. Engine 10 is, by way of example, a diesel engine that comprises a turbocharger 14. When used in a motor vehicle, such as a truck, engine 10 is coupled through a drivetrain 16 to driven wheels 18 that propel that the vehicle.

Engine 10 comprises multiple cylinders 20 (six in-line in this example) forming combustion chambers into which fuel is injected by fuel injectors 22 to mix with charge air that has entered through the intake system Reciprocating pistons 23 are disposed in cylinders 20 and coupled to an engine crankshaft 25. The mixture in each cylinder 20 combusts under pressure created by the corresponding piston 23 as the engine cycle passes from its compression phase to its power phase, thereby driving crankshaft 25, which in turn delivers torque through drivetrain 16 to wheels 18 that propel the vehicle. Gases resulting from combustion are exhausted through exhaust system 12.

Engine 10 comprises an engine control system (ECS) 24 that comprises one or more processors that process various data to develop data for controlling various aspects of engine operation. ECS 24 acts via an injector driver module (IDM) 26 to control the timing and amount of fuel injected by each fuel injector 22. During one engine cycle, single or multiple injections may occur. For example, a main injection of fuel may be preceded by a pilot injection and/or followed by a post-injection.

FIG. 2 shows that engine 10 also comprises a hydraulic system 28 that includes an engine-driven pump (not specifically shown) for pumping hydraulic fluid to an injector oil rail, or injector oil gallery, 32 that serves fuel injectors 22. ECS 24 controls the pressure of hydraulic fluid, or oil, in injector oil rail 32 (i.e., controls ICP) by exercising control over one or more components of hydraulic system 28 that may include the pump and/or an associated hydraulic valve (not specifically shown).

Figure 5:
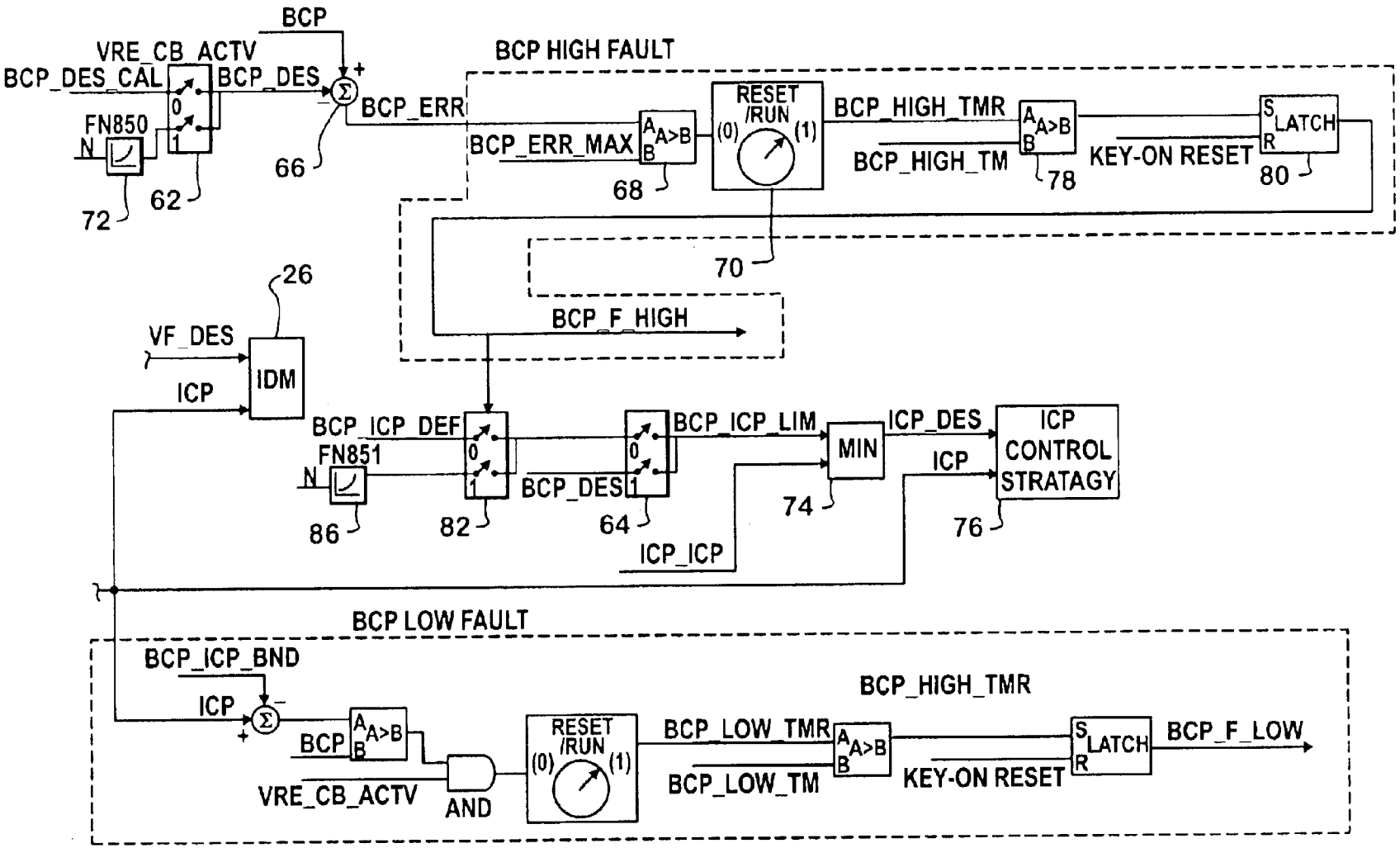
FIG. 5 is a schematic software strategy diagram of an exemplary embodiment of BCP strategy and its integration with ICP strategy in an engine control strategy for the engine of the previous Figures in accordance with principles of the present invention.
Figure 5:
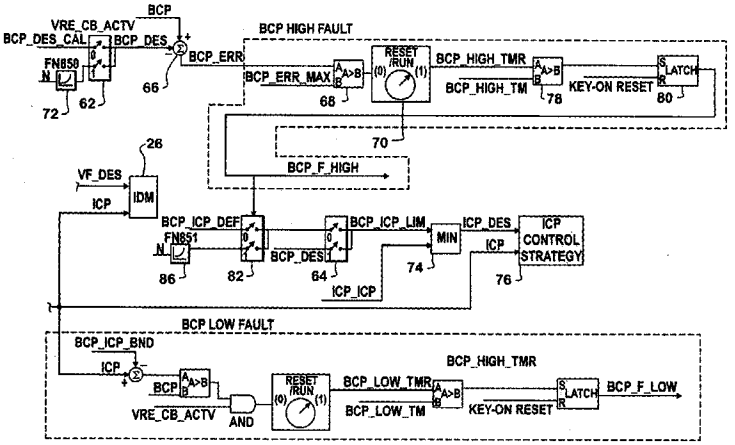

A sensor 34 senses the actual hydraulic pressure in rail 32 to supply a data value therefor to ECS 24 as an element of the ICP control strategy. The value of a parameter ICP in FIG. 5 represents that sensed pressure. ICP is also supplied as a data input to IDM 26, either directly from sensor 34 or from ECS 24.

FIG. 5 shows that ECS 24 sets engine fueling by developing a value for a data input VF_DES representing desired fueling and then supplying the value to IDM 26. IDM 26 processes various data, including, the data values for ICP and VF_DES to develop properly timed pulse widths for pulses that are applied to fuel injectors 22 for opening internal valve mechanisms that allow ICP to force fuel from injectors 22 into cylinders 20.

When a pulse from IDM 26 operates a valve mechanism of a fuel injector 22, hydraulic fluid at ICP is enabled to act on a piston in the fuel injector to force an injection of fuel into the respective combustion chamber. And as discussed earlier, such an injection may be a pilot injection, a main injection, or a post-injection. Fuel injectors of this general type are disclosed in various prior patents.

The engine brake system takes advantage of the existing turbocharger 14 and the existing individual exhaust valves 36 (shown in FIGS. 3 and 4) at individual cylinders 20. By operating an internal mechanism of turbocharger 14, such as vanes, to create a certain restriction on the flow through exhaust system 12, and at the same time forcing all exhaust valves 36 to be open to some extent, the kinetic energy of the moving motor vehicle operates engine 10 like a pump that forces contents of engine cylinders 20 through the created restriction. Such forced dissipation of the kinetic energy of the vehicle slows the vehicle.

Figure 4:
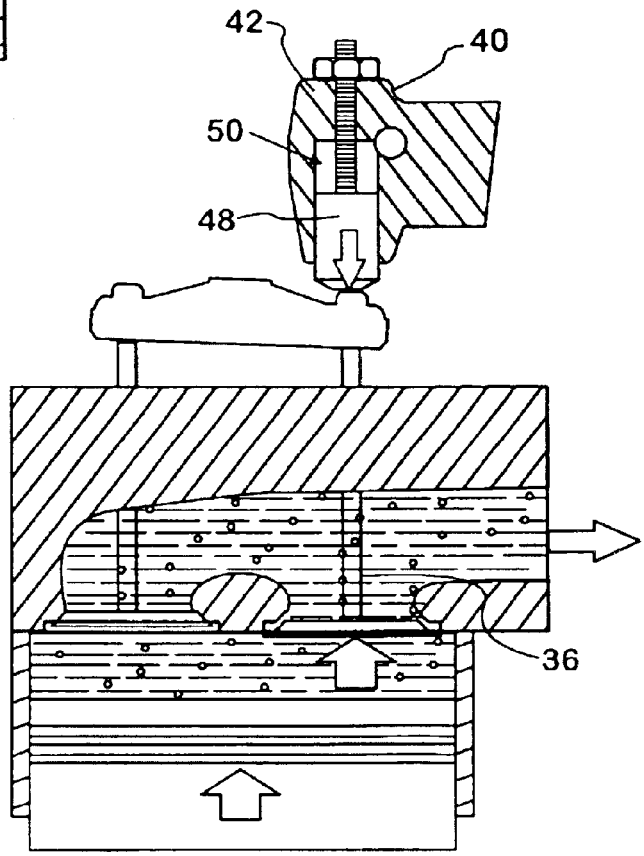
FIG. 4 is a cross section view like FIG. 3, but showing another operating condition.

Each exhaust valve 36 is forced open by a respective hydraulic actuator 40 of the engine brake system as shown by FIG. 4 depicting the actuated condition of an actuator 40. FIG. 3 shows the non-actuated condition of actuator 40. When exhaust valves 36 are not being forced open by actuators 40, they operate at proper times during the engine cycle to allow products of combustion to exit cylinders 20 and pass into exhaust system 12. In that regard, engine 10 may have a camshaft for operating the valves or alternatively may be a "camless" engine.

Each actuator 40 comprises a body 42 having a port 44 that is in fluid communication with a brake oil gallery 46 that is arranged generally parallel with injector oil gallery 32 in engine 10. A plunger, or piston, 48 is disposed within a bore 50 in body 42 for displacement over a limited distance. FIG. 3 shows piston 48 retracted and FIG. 4 shows it deployed. Deployment occurs when a suitable amount of hydraulic fluid is introduced into brake oil gallery 46 at a pressure sufficient to impart enough force to each piston 48 to cause the piston to move within its bore 50 in the direction that will force the piston to open the corresponding exhaust valve 12.

For enabling the engine brake to take advantage of hydraulic system 28, brake oil gallery 46 is communicated to injector oil rail 32 through a solenoid-operated valve 52, i.e. a BCP control valve. Valve 52 comprises an inlet port 54 communicated to brake oil gallery 46 and an outlet port 56 communicated to injector oil rail 32. Valve 52 closes port 54 to port 56 when its solenoid is not energized, and opens port 54 to port 56 when the solenoid is energized. ECS 24 exercises control over valve 52 via a BCP control strategy embedded in its processing system.

Another valve 58 and a pressure sensor 60 are associated with brake oil gallery 46. Valve 58 is a mechanical check valve that is open when there is little or no pressure in brake oil gallery 46 and that closes when the pressure exceeds some minimum. Sensor 60 senses the actual pressure in gallery 46 to supply a data value therefor to ECS 24 as an element of the BCP control strategy. The value of a parameter BCP in FIG. 5 represents the sensed brake oil gallery pressure.

A suitable driver circuit (not specifically shown) under the control of ECS 24 in accordance with the BCP strategy opens BCP valve 52 when the engine brake is to be applied. Otherwise BCP valve 52 is closed.

Principles of the inventive strategy are disclosed in FIG. 5. The strategy is part of the overall engine control strategy and implemented by algorithms that are repeatedly executed by a processor, or processors, of ECS 24.

Retarding of the vehicle must first be enabled (i.e., made active) in order for the BCP strategy to be executed. The data value for a parameter VRE_CB_ACTV determines whether the BCP strategy is active. When the data value for VRE_CB_ACTV is "0", the strategy is inactive, and two switch functions 62, 64 are OFF. With switch function 64 OFF, the data value for a parameter BCP_ICP_LIM is that of a parameter BCP_ICP_DEF. The latter is a default value that will be more fully explained later. With switch function 62 OFF, the data value for a parameter BCP_DES is that of a parameter BCP_DES_CAL.

With the strategy not active, BCP valve 52 is closed so that no hydraulic pressure is being applied to any actuator 40, making the data value for BCP, as sensed by sensor 60, essentially zero. BCP_DES_CAL is a calibratable parameter having a value such that when subtracted from the zero data value for BCP by a function 66, the data value for an error signal BCP_ERR is not greater than the data value for a parameter BCP_ERR_MAX. That set of conditions assures that a comparison function 68 that compares the data values for BCP_ERR and BCP_ERR_MAX prevents a clock function 70 from running so that the data value for a parameter BCP_F_HIGH is held at "0". Exactly how that occurs will be more fully explained later.

With the strategy active, the data value for VRE_CB_ACTV is "1", causing the two switch functions 62, 64 to be ON. With switch function 64 ON, the data value for parameter BCP_ICP_LIM becomes that of BCP_DES. The latter parameter represents a desired value for the pressure of the hydraulic fluid in brake oil gallery 46 that is supplied to each actuator 40. With switch function 62 ON, the data value for parameter BCP_DES is determined by a function 72 that correlates pressure value with engine speed.

Whether gallery 46 is actually pressurized however depends on whether valve 52 is open or closed. If ECS 24 is not requesting engine braking, valve 52 is closed. Whenever engine braking is requested, valve 52 is opened.

Because the source for the hydraulic fluid supplied to brake oil gallery 46 is the same as that supplied to fuel injectors 22, one of the important purposes of the strategy presented in FIG. 5 is to assure that when valve 52 is open, the pressure in injector oil rail 32 that is determined by the ICP control strategy does not create a condition where the pressure in brake oil gallery 46, ignoring certain pressure transients, exceeds BCP_DES.

That safeguard is accomplished via a minimum value function 74 that processes the data value for BCP_DES and that of another parameter ICP_ICP to ascertain which one is smaller. The data value for parameter ICP_ICP is calculated by ECS 24 according to an algorithm that takes into account various engine-and/or vehicle-related parameters to ascertain a value for ICP appropriate to current operating conditions. In general, ICP_ICP will typically exceed BCP_DES so that function 74 typically furnishes the data value for ICP_ICP as the data value for ICP_DES that is subsequently processed by a strategy 76 that controls ICP using the data value for ICP obtained from sensor 34 for feedback control.

Should a condition arise during operation of the engine brake that causes that data value for BCP_ERR to exceed the data value for BCP_ERR_MAX, function 68 will start clock function 70 running. If the condition ensues for longer than a preset time, a data output BCP_HIGH_TMR of clock function 70 will exceed a data value for a preset parameter BCP_HIGH_TM . When that happens, a comparison function 78 that is comparing BCP_HIGH_TMR and BCP_HIGH_TM sets a latch function 80.

Latch function 80 then does two things. One, it sets a fault flag BCP_F_HIGH to signal and log the event; and two, it turns a switch function 82 ON.

With both switch functions 82, 64 ON, the data value for BCP_ICP_LIM will continue to be determined by BCP_DES. But when VRE_CB_ACTV is reset to "0", a function 86 that correlates data values for BCP_ICP_LIM with engine speed sets the data value for BCP_ICP_LIM. Function 86 thereby serves to limit actual ICP, as a function of engine speed, whenever the portion of the ICP strategy that sets ICP_ICP would be requesting a higher ICP. The strategy still allows the engine to operate and the engine brake to be used as requested without excessive pressure being applied to actuators 40 until such time as engine 10 is shut off. Whenever function 86 is actively setting the data value for ICP_DES, IDM 26 makes whatever adjustments are needed to the widths of pulses used to open fuel injectors 22. When engine 10 is restarted, latch function 80 is reset.

The strategy can also set a low fault flag BCP_F_LOW in a manner similar to that of setting the high fault flag BCP_F_HIGH. With VRE_CB_ACTV set to "1", a command by ECS 24 to actuate the engine brake by commanding BCP valve 52 to open should result in the pressures in the two galleries 32, 46 being essentially equal. But if hydraulic pressure in injector oil gallery 32 continues to exceed the pressure in brake oil gallery 46 by some predetermined amount for a predetermined amount of time, failure of BCP valve 52 to properly open is indicated and low fault flag BCP_F_LOW will be set.

In light of the preceding description, the reader can now appreciate that the default value assigned to BCP_ICP_DEF is made large enough to assure that when both BCP_F_HIGH and VRE_CB_ACTV are "0", ICP_DES corresponds to ICP_ICP. And with the BCP strategy active, because an incipient BCP High Fault is indicated only when BCP_ERR begins to exceed BCP_ERR_MAX, clock function 70 cannot begin timing until that happens. That keeps BCP_F_HIGH at "0" until clock function 70 as timed an amount of time greater than BCP_HIGH_Tm at which time BCP_F_HIGH becomes "1". Once the BCP strategy becomes inactive after BCP_F_HIGH has been set to "1", the data value for BCP_ICP_LIM is set by function 86 as long as the engine continues to run. While a presently preferred embodiment of the invention has been illustrated and described, it should be appreciated that principles of the invention apply to all embodiments falling within the scope of the following claims.

What is claimed is:

1. An internal combustion engine comprising:

a fueling system for forcing fuel into engine combustion chambers where the fuel is combusted to power the engine;

an exhaust system through which exhaust gases generated by combustion of fuel in the combustion chambers pass from the engine;

an engine brake system that is associated with the exhaust system to brake the engine by controlling exhaust flow during engine braking and that comprises one or more hydraulic actuators that is or are actuated during braking of the engine by the engine brake system;

a hydraulic system for supplying hydraulic fluid under pressure both to the fueling system for forcing fuel into the combustion chambers and to the one or more actuators;

a control system for controlling various aspects of engine operation, including controlling braking of the engine by selectively communicating hydraulic fluid to the one or more actuators; and a fuel injection control strategy in the control system for closed-loop control of injection control pressure to cause injection control pressure to correspond to an injection control pressure set by the fuel injection control strategy; and a brake control pressure strategy in the control system for signaling hydraulic pressure supplied to the one or more actuators in excess of a pressure determined by the brake control pressure strategy and imposing limitation on injection control pressure when such excess pressure is signaled.

2. An engine as set forth in claim 1 wherein the control system sets one data value for a parameter to render the brake control pressure strategy active and a different data value to render the brake control pressure strategy inactive, and when the data value for the parameter changes from the one data value to the different data value after hydraulic pressure supplied to the one or more actuators in excess of pressure determined by the brake control pressure strategy has been signaled, the brake control pressure strategy causes injection control pressure to be set by a function in the brake control pressure strategy instead of by the fuel injection control strategy.

3. An engine as set forth in claim 2 wherein the function in the brake control pressure strategy that sets injection control pressure comprises data values for injection control pressure correlated with data values for engine speed, thereby causing injection control pressure to be a function of engine speed upon the data value for the parameter becoming the different data value after hydraulic pressure supplied to the one or more actuators in excess of pressure determined by the brake control pressure strategy has been signaled.

4. An engine as set forth in claim 2 wherein the brake control pressure strategy comprises a latch function in the control system that becomes latched to signal hydraulic pressure supplied to the one or more actuators in excess of pressure determined by the brake control pressure strategy, and that remains latched as long as the engine continues running.

5. An engine as set forth in claim 4 wherein the control system causes the latch function to become unlatched when the engine, after having stopped running, is again re-started.

6. An engine as set forth in claim 1 wherein the control system comprises a minimum value selection function for selecting as a data value for injection control pressure, the smaller of: the data value for injection control pressure set by the fuel injection control strategy, and the data value for injection control pressure set by the brake control pressure strategy.

7. An engine as set forth in claim 6 wherein the control system sets one data value for a parameter to render the brake control pressure strategy active and a different data value to render the brake control pressure strategy inactive, and when the data value for the parameter is the one data value, the injection control pressure set by the brake control pressure strategy is set by one portion of the brake control pressure strategy, and when the data value for the parameter is the different data value, the injection control pressure set by the brake control pressure strategy is set by another portion of the brake control pressure strategy.

8. An engine as set forth in claim 7 wherein when the data value for the parameter changes from the one data value to the different data value after hydraulic pressure supplied to the one or more actuators in excess of a desired pressure has been signaled, the injection control pressure set by the brake control pressure strategy is obtained from a function in the brake control pressure strategy that comprises data values for injection control pressure correlated with data values for engine speed, thereby causing injection control pressure to be a function of engine speed.

9. A control system for an internal combustion engine that has a fueling system for forcing fuel into engine combustion chambers where the fuel is combusted to power the engine, an exhaust system through which exhaust gases generated by combustion of fuel in the combustion chambers pass from the engine, an engine brake system that is associated with the exhaust system to brake the engine by controlling exhaust flow during engine braking and that comprises one or more hydraulic actuators that is or are actuated during braking of the engine by the engine brake system, and a hydraulic system for supplying hydraulic fluid under pressure both to the fueling system for forcing fuel into the combustion chambers and to the one or more actuators, the control system comprising:

a fuel injection control strategy for closed-loop control of injection control pressure to cause injection control pressure to correspond to an injection control pressure set by the fuel injection control strategy; and a brake control pressure strategy for controlling braking of the engine by selectively communicating hydraulic fluid to the one or more actuators, for signaling hydraulic pressure supplied to the one or more actuators in excess of a pressure determined by the brake control pressure strategy, and for imposing limitation on injection control pressure when such excess pressure is signaled.

10. A control system as set forth in claim 9 wherein the brake control pressure strategy, when active, is capable of braking the engine and when inactive, is incapable of braking the engine, and when the brake control pressure strategy switches from being active to being inactive, the brake control pressure strategy causes injection control pressure to be set by a function in the brake control pressure strategy instead of by the fuel injection control strategy.

11. A control system as set forth in claim 10 wherein the function in the brake control pressure strategy that sets injection control pressure comprises data values for injection control pressure correlated with data values for engine speed, thereby causing injection control pressure to be a function of engine speed upon the brake control pressure strategy switching from being active to being inactive.

12. A control system as set forth in claim 10 wherein the brake control pressure strategy comprises a latch function that becomes latched to signal hydraulic pressure supplied to the one or more actuators in excess of pressure determined by the brake control pressure strategy, and that remains latched as long as the engine continues running.

13. A control system as set forth in claim 12 wherein the latch function unlatches upon re-starting of the engine after having been stopped.

14. A control system as set forth in claim 9 comprising a minimum value selection function for selecting as a data value for injection control pressure, the smaller of: the data value for injection control pressure set by the fuel injection control strategy, and the data value for injection control pressure set by the brake control pressure strategy.

15. A control system as set forth in claim 14 wherein the brake control pressure strategy, when active, is capable of braking the engine and when inactive, is incapable of braking the engine, and when the brake control pressure strategy switches from being active to being inactive, the control system sets one data value for a parameter to render the brake control pressure strategy active and a different data value to render the brake control pressure strategy inactive, and when the data value for the parameter is the one data value, the injection control pressure set by the brake control pressure strategy is set by one portion of the brake control pressure strategy, and when the data value for the parameter is the different data value, the injection control pressure set by the brake control pressure strategy is set by another portion of the brake control pressure strategy.

16. A control system as set forth in claim 15 wherein when the data value for the parameter changes from the one data value to the different data value, the injection control pressure set by the brake control pressure strategy is obtained from a function in the brake control pressure strategy that comprises data values for injection control pressure correlated with data values for engine speed, thereby causing injection control pressure to be a function of engine speed.

17. A method for control of pressure of hydraulic fluid in a hydraulic system of an internal combustion engine that has a fueling system for forcing fuel into engine combustion chambers using the hydraulic fluid, an exhaust system through which exhaust gases generated by combustion of fuel in the combustion chambers pass from the engine, and an engine brake system that is associated with the exhaust system to brake the engine by controlling exhaust flow during engine braking and that comprises one or more hydraulic actuators that is or are actuated during braking of the engine by the engine brake system, wherein the hydraulic system supplies hydraulic fluid both to the fueling system and to the one or more actuators, the method comprising:

setting pressure of the hydraulic fluid by an injection control strategy;

controlling braking of the engine by selectively communicating hydraulic fluid to the one or more actuators;

signaling hydraulic pressure supplied to the one or more actuators in excess of a pressure determined by a brake control pressure strategy; and imposing limitation on pressure of the hydraulic pressure when such excess pressure is signaled.

18. A method as set forth in claim 17 selectively rendering the brake control pressure strategy active for enabling braking of the engine and inactive for disabling braking of the engine, and when the brake control pressure strategy is rendered inactive after having been active, causing pressure of the hydraulic fluid to be set by a function in the brake control pressure strategy instead of by the fuel injection control strategy.

19. A method as set forth in claim 18 comprising selecting as a data value for pressure of the hydraulic fluid, the smaller of: a data value for injection control pressure set by the fuel injection control strategy, and a data value for injection control pressure set by the brake control pressure strategy.

* * * * *

UNITED STATES PATENT AND TRADEMARK OFFICE

CERTIFICATE OF CORRECTION

PATENT NO. : 6,779,506 B1 
DATED : August 24, 2004
INVENTOR(S) : James T. Beaucaire, David S. Hlavac and David V. Rodgers It is certified that error appears in the above-identified patent and that said Letters Patent is hereby corrected as shown below:

Drawings,
Figure 5 should be replaced with the attached drawing.

Signed and Sealed this

Sixteenth Day of May, 2006

JON W. DUDAS
*Director of the United States Patent and Trademark Office*